US005490051A

United States Patent [19]

Messana

[11] Patent Number: 5,490,051

[45] Date of Patent: Feb. 6, 1996

[54] SELF-POSITIONING LAMP FIXTURE WITH INTEGRALLY FORMED UNITARY SUPPORT STRUCTURE

[76] Inventor: Joseph Messana, 1343 S. Schmuhl Rd., New Lenox, Ill. 60451

[21] Appl. No.: 143,772

[22] Filed: Nov. 1, 1993

Related U.S. Application Data

[63] Continuation-in-part of Ser. No. 19,491, Feb. 19, 1993, Pat. No. 5,381,325.

[51] Int. Cl.[6] ..... F21V 21/20

[52] U.S. Cl. ..... 362/401; 362/269; 362/278; 362/294; 362/320; 362/373; 362/387; 362/414; 248/910

[58] Field of Search ..... 248/292.1, 364, 248/910; 40/608; 362/269, 274, 275, 285, 287, 288, 294, 373, 384, 387, 401, 414, 418–421, 427, 431, 410, 278, 320

[56] References Cited

U.S. PATENT DOCUMENTS

| | | | |
|---|---|---|---|
| 524,894 | 8/1894 | Forsberg | 248/364 |
| 1,081,498 | 12/1913 | Gudeman | 362/414 |
| 1,670,525 | 5/1928 | Savery | 248/910 |
| 3,699,913 | 10/1972 | Sautbine | 40/608 |
| 4,521,836 | 6/1985 | Puttemanns et al. | 362/421 |
| 4,739,302 | 4/1988 | Kinard | 40/608 |
| 5,134,555 | 7/1992 | Messana | 362/401 |
| 5,147,132 | 9/1992 | Lee | 362/427 |

FOREIGN PATENT DOCUMENTS

| | | | |
|---|---|---|---|
| 170258 | 2/1960 | Sweden | 362/410 |
| 313174 | 7/1930 | United Kingdom | 362/410 |

*Primary Examiner*—Ira S. Lazarus
*Assistant Examiner*—Alan B. Cariaso
*Attorney, Agent, or Firm*—Leydig, Voit & Mayer, Ltd.

[57] ABSTRACT

A self-positioning lamp fixture with an integrally formed unitary support structure, including a self righting rounded lower wall terminating in a flat portion to stabilize the lamp structure when in its upright position. A continuous cavity extends throughout the integrally formed support structure making it lightweight. A weight receiving recess is provided at the lower end having an open wall across the flat portion of the structure's lower wall to receive a cylindrical weight therein. The cylindrical weight is removable and is held in the weight receiving recess by removable lag screws. The cylindrical weight has a planar bottom wall which covers the open wall across the flat portion of the structure's lower wall when the cylindrical weight is secured in place within the weight receiving recess. A ventilation and cooling system is provided to cool the lamp assembly, comprising ventilation intake and discharge apertures and a blower to flow cooling air into, through and out of the lamp fixture and its lamp assembly. A flexible sheet reflector is provided which may be folded up when not in use and held in its folded up position on the lamp fixture until such time as it is to be used again. An annular recess is provided to receive and store the electrical cord when not in use. An auxiliary convenience outlet is provided on the wall of the lamp fixture. In a modification of the invention, a universal ball and socket swivel mount is provided for the lamp assembly at the upper end of the lamp fixture to enable pivoting the lamp to any desired pivotable position.

43 Claims, 7 Drawing Sheets

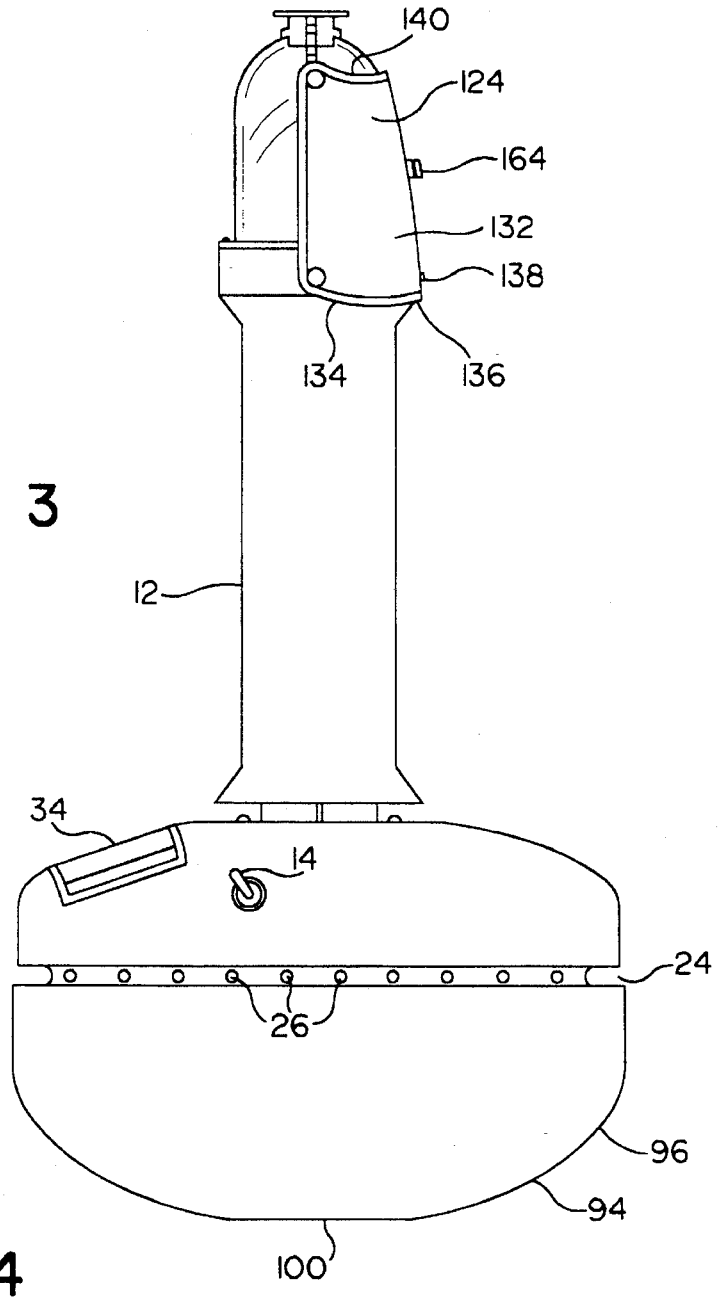
FIG. 3
FIG. 4
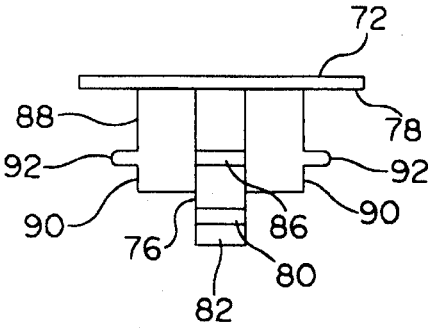
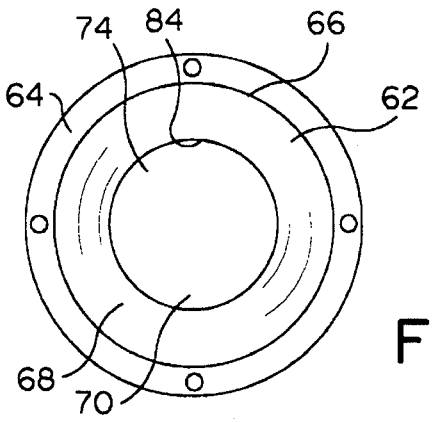
FIG. 5

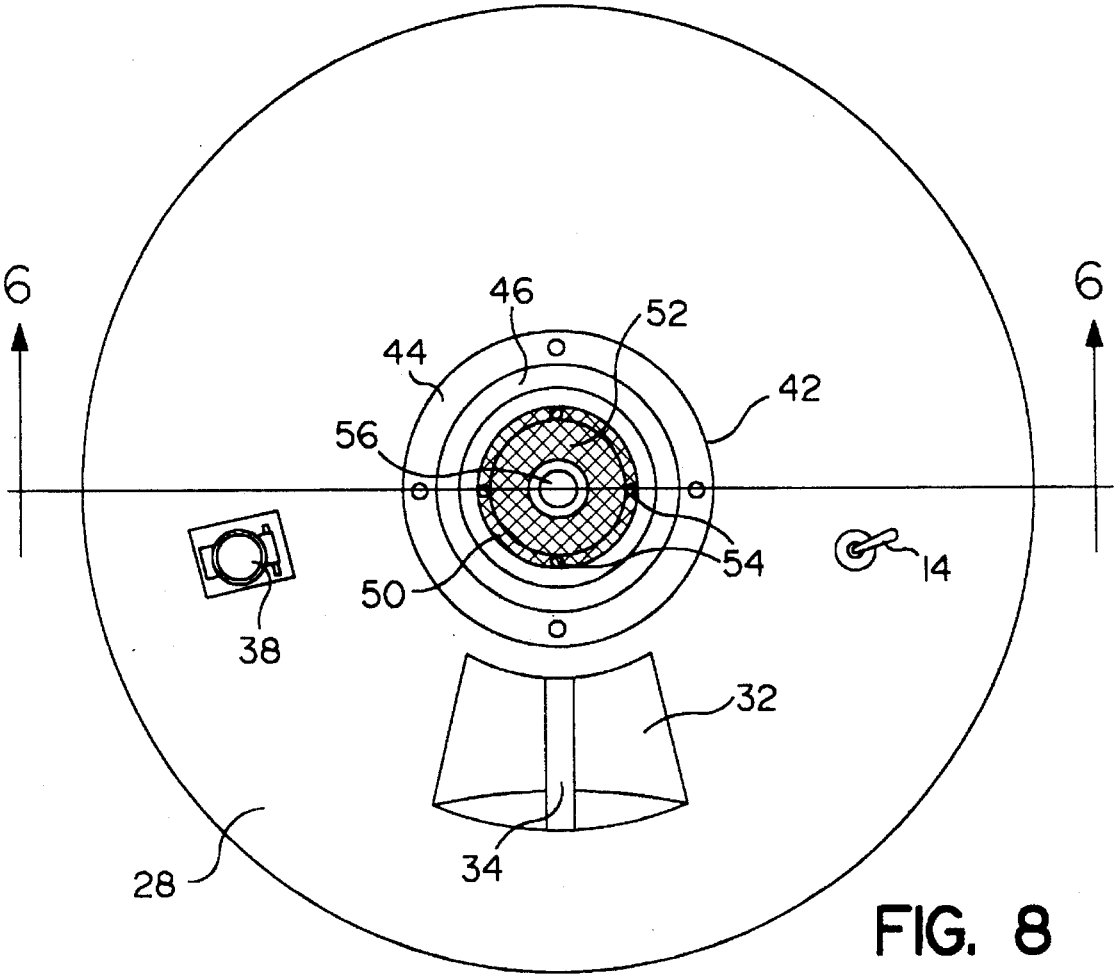
FIG. 8
FIG. 9
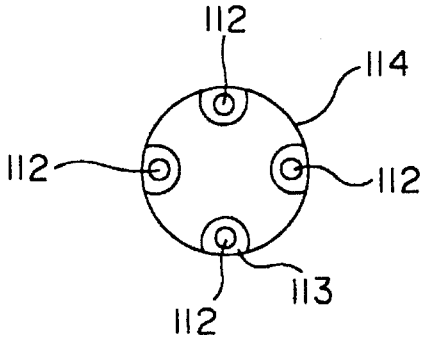
FIG. 10
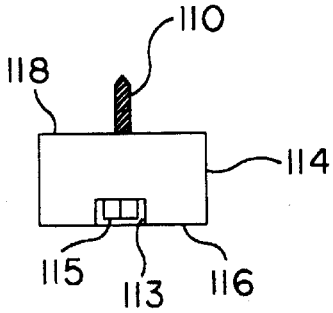

SELF-POSITIONING LAMP FIXTURE WITH INTEGRALLY FORMED UNITARY SUPPORT STRUCTURE

This application is a continuation-in-part of application Ser. No. 08/019,491 filed Feb. 19, 1993, now U.S. Pat. No. 5,381,325 issued Jan. 10, 1995.

BACKGROUND OF THE INVENTION

This invention relates to improvements in self-positioning or self-righting lamp fixtures of the type which return to their upright position when tipped away therefrom. In particular, the lamp fixture in accordance with this invention comprises an integrally formed unitary structure, having a continuously joined peripheral wall of sturdy material to significantly reduce the likelihood of damage to the lamp fixture although used at construction sites and other high risk areas.

Prior art lamp fixtures for use at construction sites, campgrounds and other areas where a number of people are involved in active work or play will normally fall over if accidentally hit. The fixture itself may be damaged. It may cause damage to other things when knocked over. The present invention provides a better solution to those problems by its integrally formed, unitary construction and its self righting as well as stabilizing lower portion.

PRIOR ART KNOWN TO THE INVENTOR

Prior art lamp fixtures of various kinds have included self-righting features. Those known to the inventor include those which are disclosed in the following patents including the inventor's own Pat. No. 5,134,555 disclosing a self-positioning lamp fixture.

U.S. Pat. No. 5,001,617 discloses a self balanced, multi position holder which includes structure that will hold the arm of the device at any angle at which it is positioned.

U.S. Pat. No. 4,739,302 discloses a road construction barrier or marker of frusto-conical configuration having a rounded portion near the bottom terminating in a flat bottom wall. The weighted portion or ballast is stated to be rigidly secured in the lower part of the base and is shaped in the form of a cone to produce the value and positioning of the center of gravity desired in that invention.

U.S. Pat. No. 4,117,455 discloses a self-righting roadway marking device having a rounded base of elastomeric material and an upright staff having a light bulb at the top. Wind vanes are secured to the staff to enable the wind to tip and rotate the lighted marking device on its rounded elastomeric base so as to attract more attention to the tipping and rotating light.

U.S. Pat. No. 4,028,543 discloses a baseless lamp fixture having an elongated tubular element with a light bulb at one end and a counterweight at the other, bent in such a way that an intermediate section of the elongated tubular element can be placed on a support member and the counterweight at one end will hold the light bulb at the other end in place.

U.S. Pat. No. 3,863,882 discloses a self balancing support for holding a book, magazine, newspaper or the like at a desired angle. Adjustable bags containing fluent material are connected to the box-like supporting structure having a back panel which can be manipulated in such a way as to hold the supporting structure and back panel at a desired position.

U.S. Pat. No. 1,439,101 discloses a traffic fixture having a pear shaped base, an upright member and a light fixture at the top. A plurality of legs are provided at the bottom to prevent the device from spinning or rotating on its longitudinal axis.

U.S. Pat. No. 1,228,615 discloses a self-righting guide post having a solid base with a slightly curved side wall, a convex top wall and a flat bottom wall, and a slender upright member extending upwardly from the base to which a flag may be attached, or to which a lamp fixture or light bulb may be secured.

U.S. Pat. No. 827,199 discloses a light fixture having a weighted base of generally triangular form.

U.S. Pat. No. 713,364 discloses a buoy having a pear shaped flotation member and a lamp fixture supported thereon, for connection to fishing nets to illuminate the nets and thereby attract fish.

U.K. Patent No. 313,174 discloses a lamp stand having a spherical base with a weight therein and an upright member with a light fixture at the top.

French Patent No. 714,784 discloses a table lamp having an upright support, a light bulb and lamp shade at the upper end, a small sphere or ball of rubber or the like at its lower end to rest on the surface of a table, a semi-circular shaft extending from the small sphere downwardly having a small weighted ball at the lower end of such semi-circular shaft.

Italian Patent No. 312,687 discloses lighting fixtures to outline airport runways which have a rounded base, an upright support member and a light fixture at the top. A battery or transformer is placed in the cavity of the rounded base to provide the electrical energy for the light bulb.

SUMMARY OF THE INVENTION

The self-positioning lamp fixture in accordance with the present invention provides a number of improvements over those devices known to the prior art.

It provides an integrally formed unitary structure of sturdy thermoplastic material which lessens the likelihood of damage to the lamp fixture and breakage.

It has a hollow cavity from the upper end to the lower end of the lamp fixture support structure making it light weight for easy portability.

It has a spherical segment lower peripheral wall terminating in a flat open wall at the bottom which opens to a weight receiving recess thereby enabling the lamp structure to right itself when tipped and to remain stable in such upright position on the flat bottom wall of a cylindrical weight received in the weight receiving recess.

It has lag screw receiving apertures in the weight receiving recess for securing the cylindrical weight in such recess and enabling removal of such weight therefrom.

An access aperture is provided in the weight receiving recess to enable working access to the interior cavity of the lamp structure when the weight is removed.

A ventilating blower is mounted in the cavity of the lamp structure to flow cooling ambient air into the cavity through ventilating apertures spaced apart around the periphery of the lamp structure and upwardly to cool the lamp assembly mounted at the upper end of the lamp fixture.

An annular recess is provided around the large diameter lower portion of the integrally formed peripheral wall of the lamp fixture to receive the wound up electrical cord for storage therein.

An auxiliary electrical outlet is provided on the peripheral wall of the lamp fixture to which a workman's electrical tool such as a drill or the like may be conveniently connected.

A shock absorbing mounting structure is provided in which to mount the electrical socket to absorb shock waves that may be transmitted to the lamp fixture and prevent them from reaching the socket and bulb received therein, such shock absorbing mounting structure comprising a screen secured across the upper wall aperture of the lamp fixture with the electrical socket secured in an aperture through its center.

The lamp assembly includes a dome placed over the bulb and socket, having an open bottom wall facing the upper wall aperture of the lamp fixture to receive cooling air blown therethrough by the blower into the cavity of the lamp assembly dome, such dome having a dome ventilating aperture at its upper end for the cooling air to discharge back into the atmosphere.

A ventilating cap is provided to cover the dome ventilating aperture in spaced apart relationship thereabove to enable air to escape through such aperture.

A flexible sheet reflector is provided, comprising an inner reflective coating and an outer sheet of flexible sheet material which is waterproof, heat resistant and resistant to other damage. The flexible sheet reflector may be folded to a folded up position for storage in place on the lamp fixture itself and may be unfolded for use. Snaps or other fastening devices are provided to hold the flexible sheet reflector in place around one portion of the lamp assembly dome to reflect light outwardly from its opposite side when in its unfolded position for use. The flexible sheet reflector may be unsnapped and folded to its folded up position when its use as a reflector is not needed, and snaps are provided to hold the folded up reflector in such position on the peripheral wall of the lamp fixture until the reflector is again going to be used.

In a modified form of the invention, a universal swivel assembly is provided at the upper end of the lamp fixture on which to mount the lamp assembly. The universal swivel assembly comprises a spherical segment socket member and a spherical ball member received in the cavity of the socket member. The lamp assembly is mounted above the spherical segment socket member, whereupon it can be pivoted to any desired position on which the socket member is able to swivel on the spherical ball member.

BRIEF DESCRIPTION OF THE DRAWING

FIG. 3 is a side elevation view of the self-positioning lamp fixture of FIGS. 1 and 2 showing the flexible flap reflector in its unfolded position and snapped in place over the rear portion of the lamp assembly dome.

FIG. 4 is an elevation view of the ventilation cap to cover the ventilation aperture of the lamp assembly dome.

FIG. 5 is a top plan view of the lamp assembly dome.

FIG. 8 is a top plan view of the lamp fixture in accordance with this invention shown with the lamp assembly dome and bulb removed.

FIG. 9 is a bottom plan view of the cylindrical weight for securing in the bottom weight receiving access of the self-positioning lamp fixture in accordance with this invention.

FIG. 10 is a side elevation view of the cylindrical weight shown in FIG. 9 with one of the securing lag screws shown extending through one of the screw receiving bores of the weight.

DESCRIPTION OF PREFERRED EMBODIMENT

Figure 1:
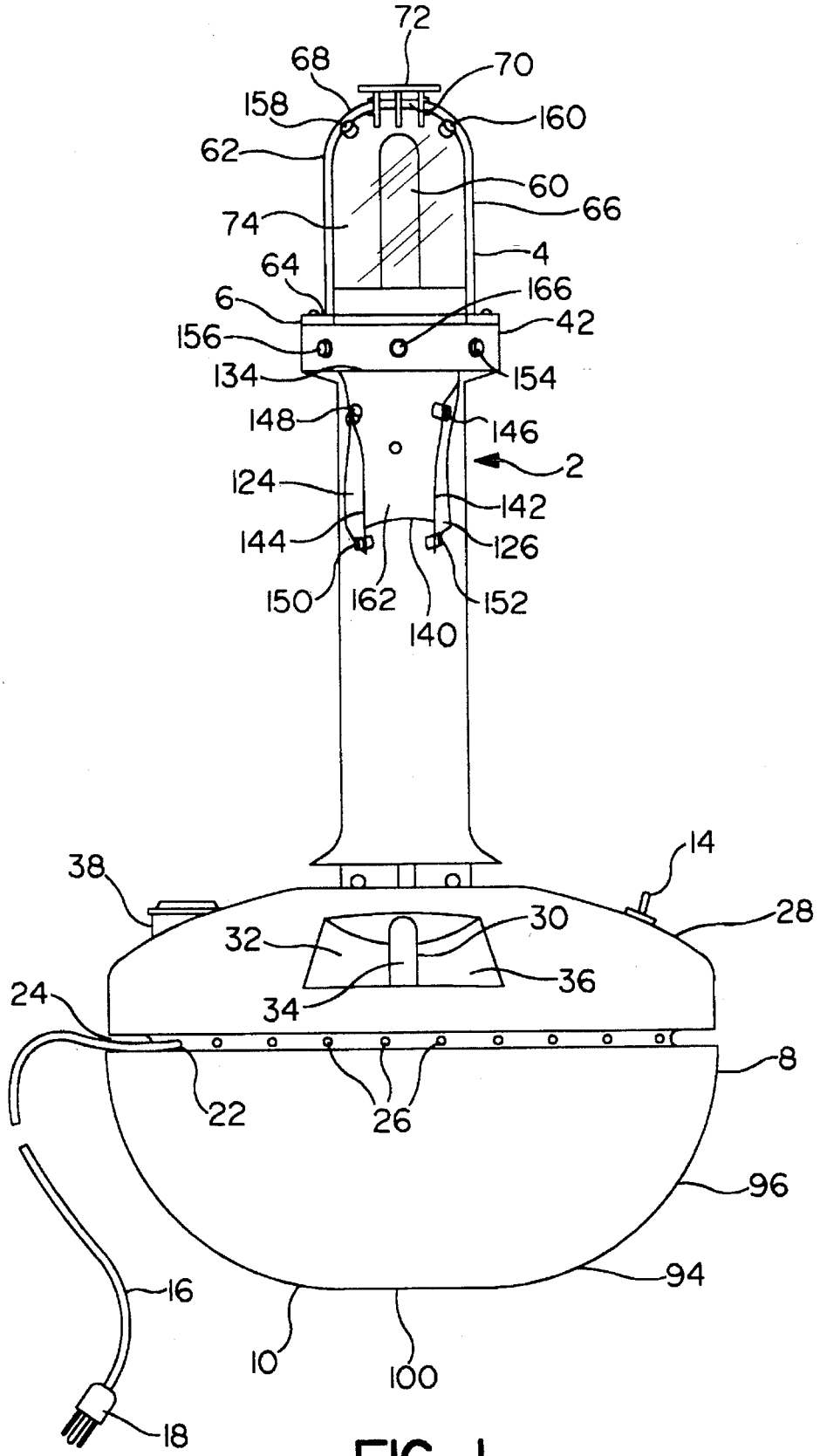
FIG. 1 is a rear elevation view of a self-positioning lamp fixture in accordance with this invention, having its flexible flap reflector unsnapped and hanging down prior to being folded up and secured for storing on the lamp fixture until it is to be used again.
Figure 2:
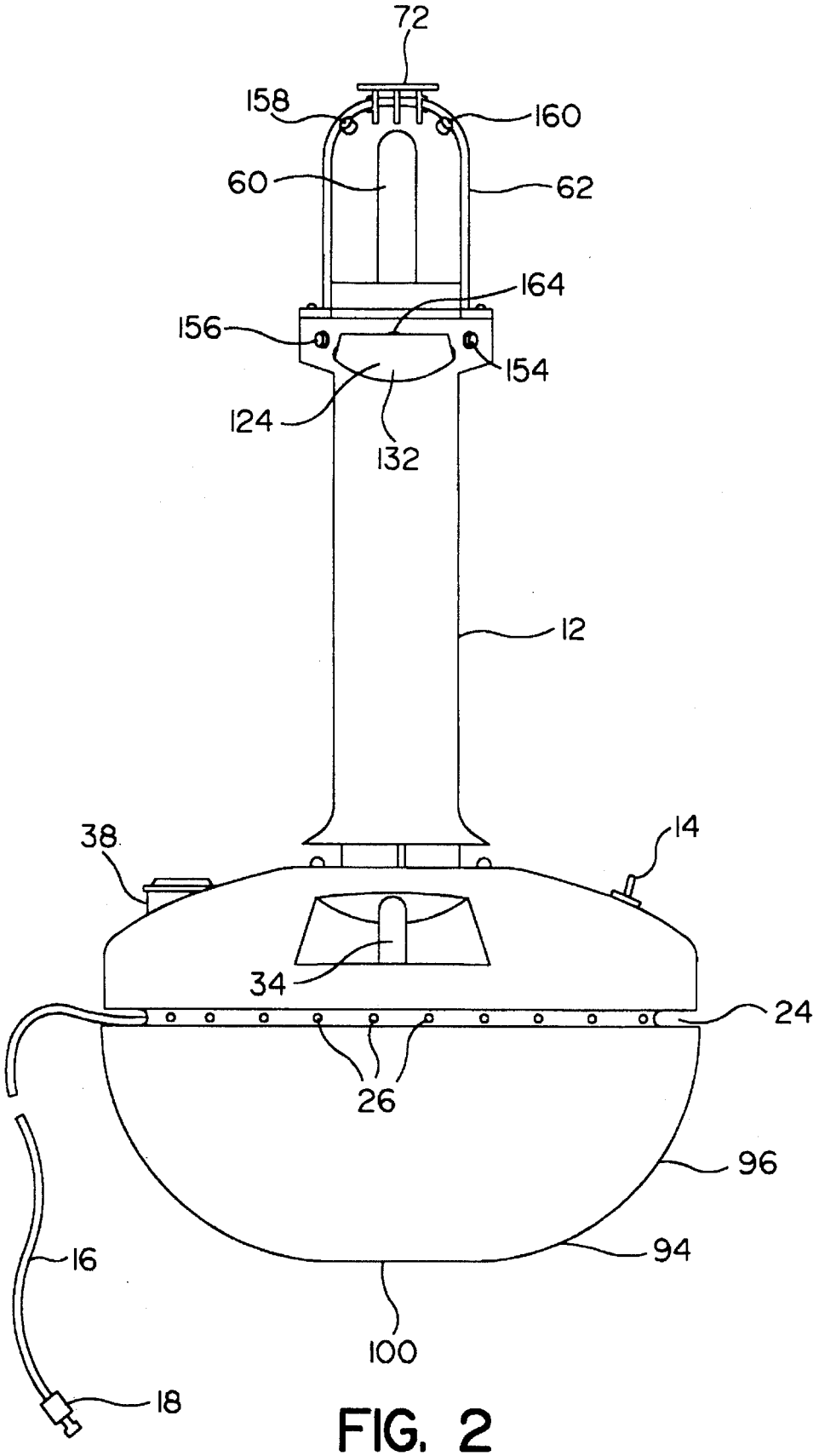
FIG. 2 is a rear elevation view of the self-positioning lamp fixture of FIG. 1 showing its flexible flap reflector folded up and secured in its folded up position on the lamp fixture.
Figure 6:
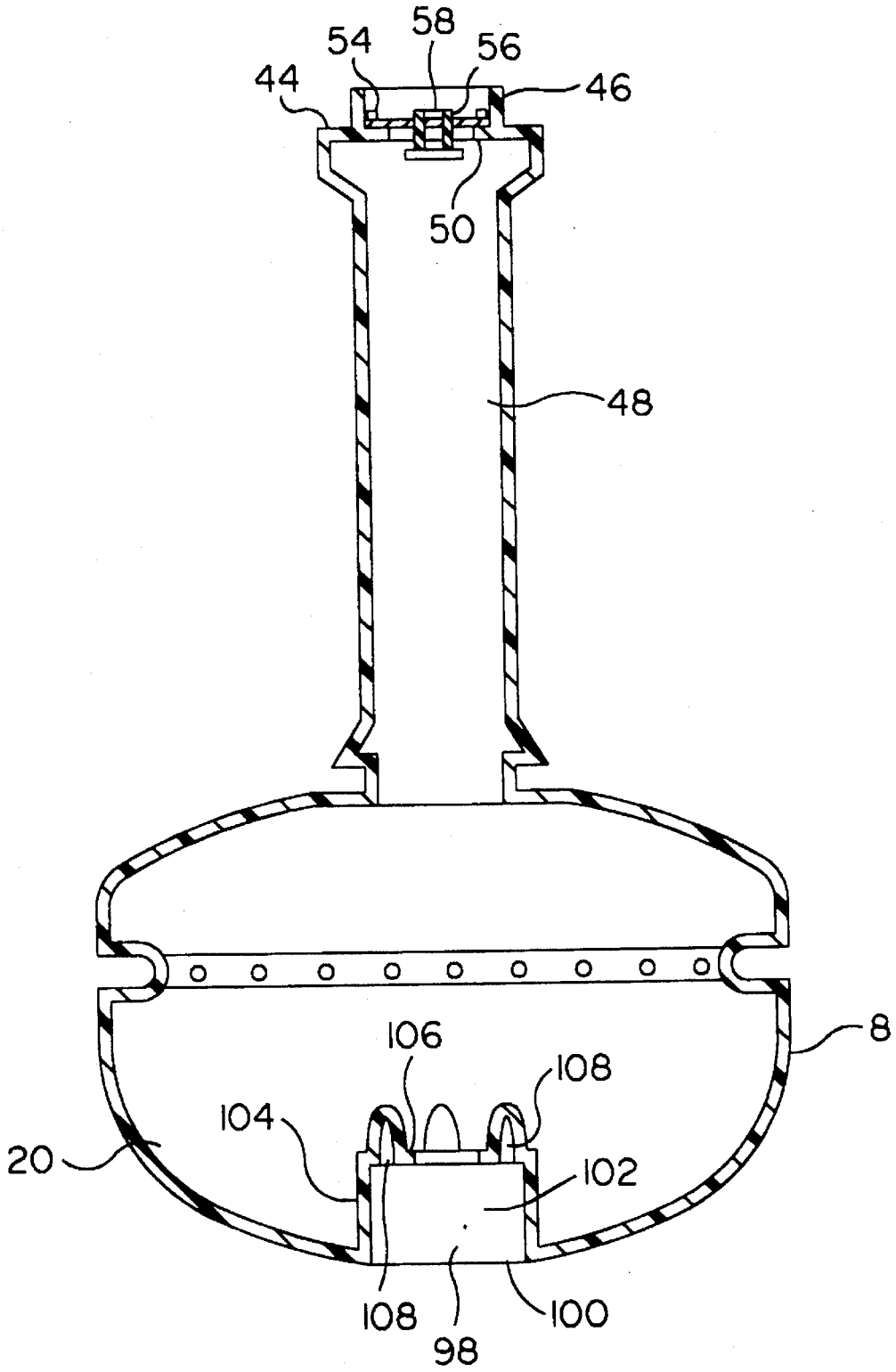
FIG. 6 is a section view taken on line 6—6 of FIG. 8 to illustrate the integrally formed unitary structure which comprises the lamp fixture in accordance with this invention on which the lamp assembly is mounted.
Figure 7:
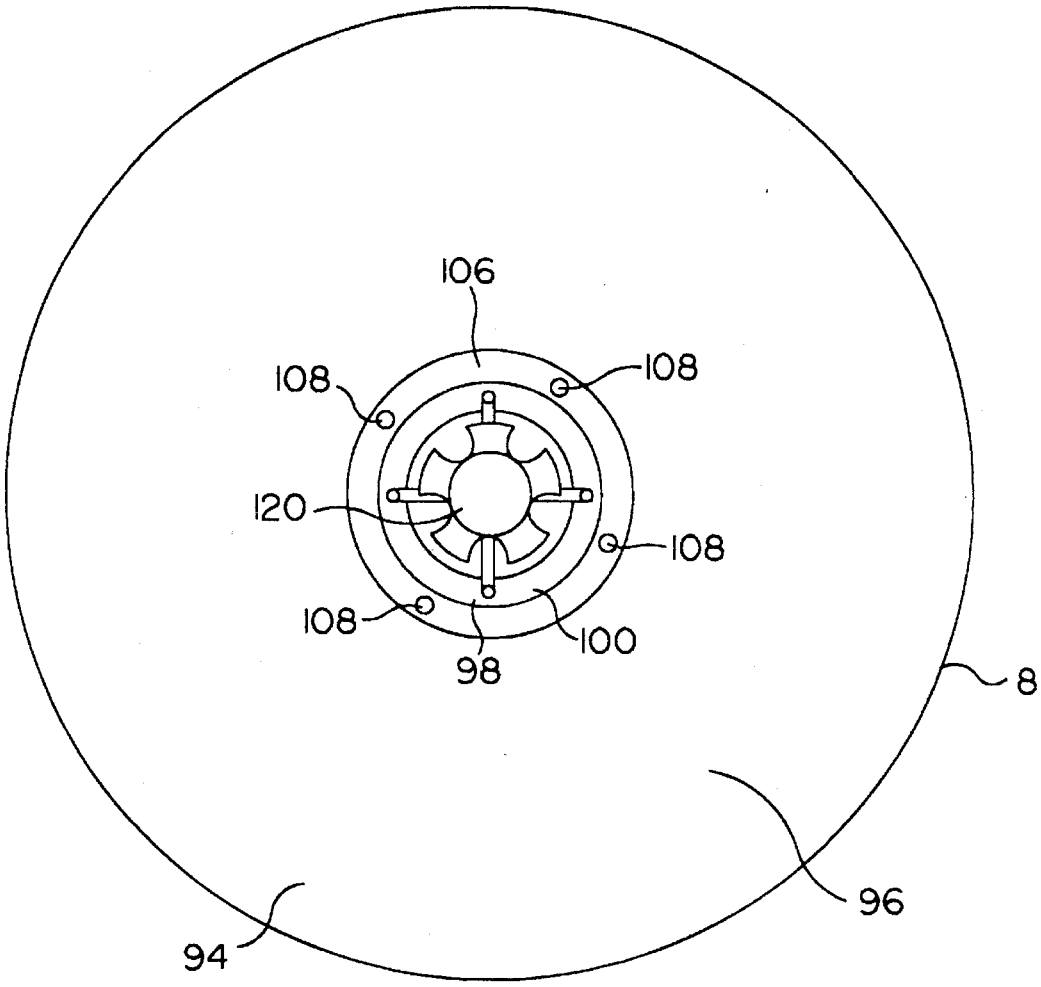
FIG. 7 is a bottom plan view of the lamp fixture in accordance with this invention shown with its weight receiving recess open.
Figure 11:
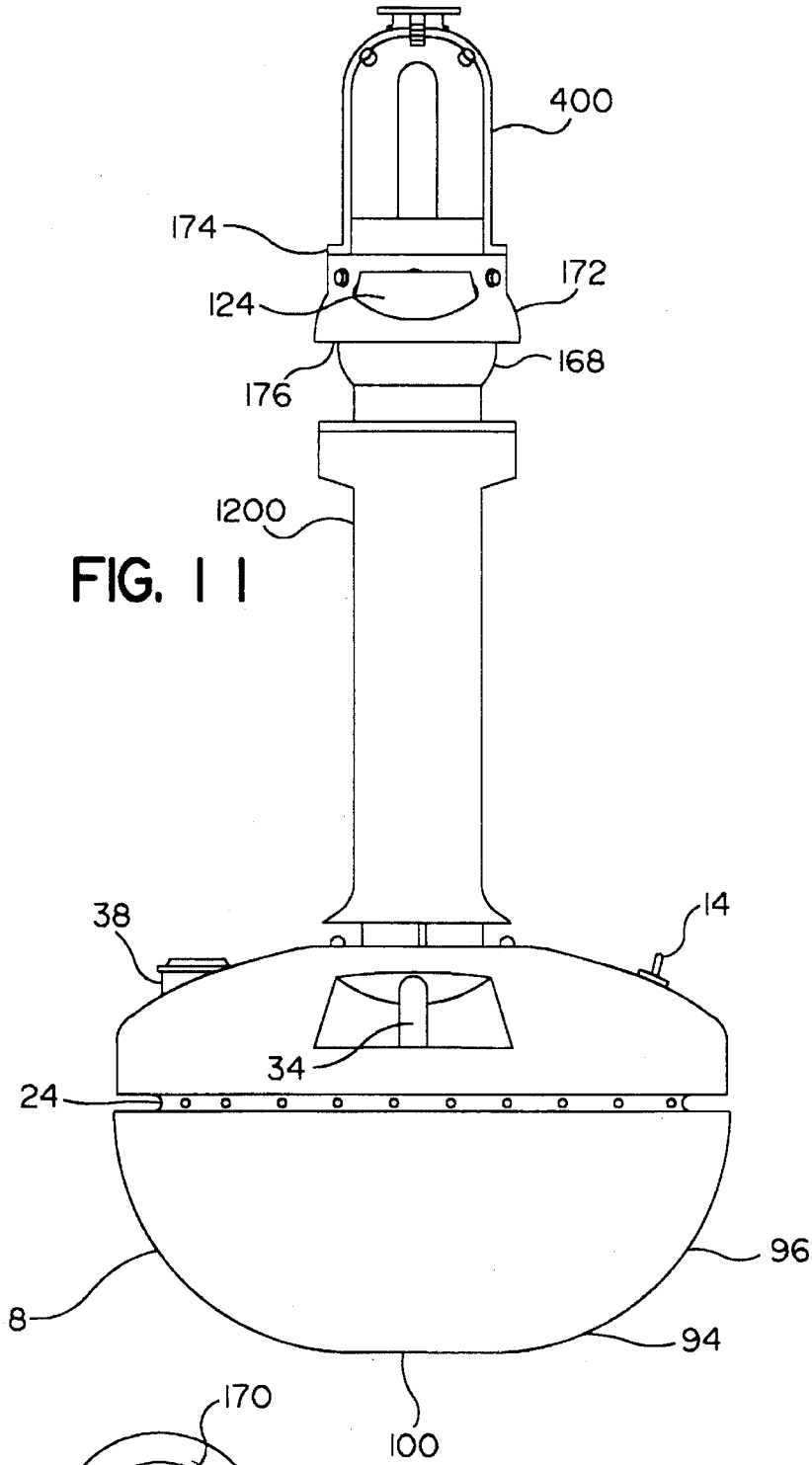
FIG. 11 is a rear elevation view of a modified form of the self-positioning lamp fixture in accordance with this invention having a universal swivel mount for the lamp assembly.
Figure 12:
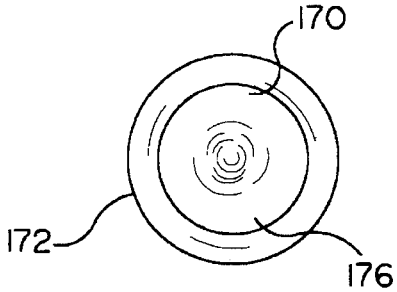
FIG. 12 is a bottom plan view of the spherical segment socket member of the universal swivel mount showing its cavity in which the spherical insert member is received.
Figure 13:
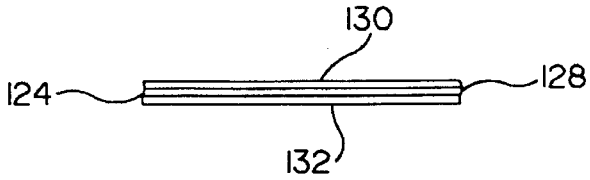
FIG. 13 is an end elevation view of a fragment of the flexible flap reflector to show the separate layers of flexible sheet material of which the flexible sheet reflector is comprised.

The self-positioning lamp fixture in accordance with the present invention comprises an elongated support member 2 having a lamp assembly 4 at its upper end 6 and a self-righting or self-positioning structure 8 at its lower end 10.

An elongated support section 12 extends upwardly from the self-positioning structure 8 to the lamp assembly 4. An electrical switch 14 is mounted on the self-positioning structure 8, and an electrical supply cord 16 is connected at one end to the switch 14 and at the opposite end to an electrical plug 18. The cord 16 extends from its connection to the switch 14 within the cavity 20 of the self-positioning structure 8, and out through an aperture 22 which opens to an annular recess 24 around the periphery of the self-positioning structure 8.

The annular recess 24 provides a storage space for the electrical cord 16.

A plurality of ventilating apertures 26 also open to the annular recess 24 to allow ambient air to flow into the cavity 20 of the self-positioning structure 8.

The self-positioning structure 8 has an upwardly sloping annular wall 28 which extends from the annular recess 24 to the base of the elongated support section 12. A hand grasp structure 30 is positioned on the upwardly sloping annular wall 28, comprising a handgrasp recess 32 large enough to receive a person's fingers and hand, and a cylindrical handle bar 34 extending across the open wall entrance 36 to the handgrasp recess 32. The handle bar 34 is integrally joined at each opposite end to the upwardly sloping annular wall 28.

An electrical outlet 38 is also mounted on the upwardly sloping annular wall 28, and electrical conductors are connected between the outlet 38 and the electrical supply cord 16.

The elongated support section has an enlarged diameter section 42 at its upper end, terminating in an outer annular flange 44 facing upwardly and extending around a smaller diameter short cylindrical wall 46 surrounding cylindrical cavity 48 which extends through the elongated support section 12 from its upper end to its lower end at which it opens to the cavity 20 of the self-positioning structure 8.

An inner annular flange 50 extends radially inwardly of the cavity 48 a short distance starting from the lower edge of the inner surface of the short cylindrical wall 46.

A circular metal screen 52 is seated in the circular space defined by the short cylindrical wall 46 and bounded by its inner surface, supported around its peripheral edge by the inner annular flange 50. Four screws 54 extend through the circular metal screen 52 at radially spaced apart locations and into the inner annular flange 50 to secure and hold the metal screen 52 in place.

An electrically insulated bulb socket 56 extends through the center of the metal screen 52 and is secured thereto, having its open socket end 58 facing upward from the metal screen 52 to receive an electrical bulb 60 therein. Electrical conductors in cord 16 are connected between the terminals of socket 56 and those of the switch 14 to complete an electrical circuit between the electrical supply cord 16 and the electrical bulb 60 when the switch 14 is switched to its contacts closed position.

The circular metal screen 52 to which the insulated electrical socket 56 is secured has shock absorbing characteristics which enable it to substantially absorb and thus substantially prevent transfer of shocks to the electrical socket 56 and bulb 60.

A transparent dome 62 encloses the socket 56 and bulb 60, which is preferably made of a transparent thermoplastic material which is break resistant. The dome 62 comprises an annular flange 64 at its base, a cylindrical wall 66 extending upwardly therefrom terminating in a top wall 68 in the shape of a spherical segment having a centrally located ventilation aperture 70 at the very top.

A vertilation cover plate 72 is provided for placement over the ventilation aperture 70 but spaced apart upwardly therefrom far enough for air to flow into and out of the dome cavity 74. The cover plate 72 has a diameter larger than that of the ventilation aperture 70. A pair of supporting legs 76 project downwardly from the downwardly facing surface 78 of the cover plate 72 at diametrically opposite locations, and diametrically spaced apart a distance which corresponds to the size of the diameter of the ventilation aperture 70.

Laterally extending ribs 80 extend outwardly from the outwardly facing surfaces 82 of the supporting legs 76 far enough to contact and abut against the annular edge 84 of the dome 62 which extends around the ventilation aperture 70 when the cover plate 72 is being put in position over the ventilation aperture 70. The cover plate 72 and its supporting legs 76 are preferably of a substantially rigid thermoplastic material which can flex when pressure is applied. As the cover plate 72 is pressed downward the ribs 80 of the legs 76 cause them to flex inwardly when the ribs contact the dome edge around the ventilation aperture 70 far enough for the ribs to pass whereupon the legs 76 snap back. Additional laterally extending ribs 86 on the supporting legs 76 are spaced apart upwardly from the ribs 80, and they then come into contact with the dome edge around the ventilation aperture 70 to hold the ventilation cover plate 72 in place spaced apart above the ventilation aperture 70.

A downwardly extending support wall 88 is also provided, extending down from the downwardly facing surface 78 of the cover plate 72 on a diametric line which is perpendicular or normal to the diametric line between the supporting legs 76. The length of the support wall 88 corresponds to the size of the diameter of the ventilation aperture 70 whereby the opposite end edges 90 of the support wall 88 are able to clear the surrounding edge and enter the ventilation aperture 70. A pair of lugs 92 extend laterally outward in opposite directions from the respective opposite end edges 90 of the support wall 88, spaced apart downwardly from the cover plate 72 the same distance as the additional ribs 86 of the supporting legs 76. Such lugs 92 come into supporting contact with the dome edge surrounding the ventilation aperture 70 at the same time as the additional ribs 86 of the supporting legs 76 to provide additional support for the ventilation cover plate 72 in place above the ventilation aperture 70.

The self-positioning structure 8 has a lower peripheral wall 94 comprising a spherical segment 96 which extends from the annular recess 24 downwardly therefrom to terminate at bottom circular aperture 98 which opens to the cavity 20 of the self-positioning structure 8. The bottom circular aperture 98 comprises a flat open bottom wall 100 on which the self-righting structure 8 rests when the lamp fixture in accordance with this invention is in its upright position. In other words, the flat bottom wall 100 is in full facing relationship with the floor or other planar surface on which the self-righting structure 8 of the lamp fixture is placed. Such flat bottom wall 100 stabilizes the lamp fixture when in its upright position and prevents the instability which would occur if the bottom surface in contact with the floor was continuously round or spherical.

A weight receiving recess 102 is provided inwardly of the self-positioning structure cavity 20 opening to the bottom circular aperture 98, comprising a vertically extending cylindrical side wall 104 which extends upwardly into the cavity 20 and terminates at an annular flange 106 extending horizontally in a plane that is normal to the vertical cylindrical side 104.

Four screw receiving recesses 108 open to the annular flange 106, spaced apart radially therearound and each spaced apart equidistantly from adjacent ones, to receive lag screws 110 through corresponding screw receiving bores 112 of a weighted cylindrical block 114 when received in the weight receiving recess 102. The lag screws 110 secure the weighted cylindrical block 114 within the weight receiving recess when screwed into the respective screw receiving recesses 108.

The weighted cylindrical block is selected to have a dimension and weight that will be sufficient to rotate the lamp fixture back to the upright position on its spherical segment lower peripheral wall 94 in the event it is tipped from its upright position. In a lamp fixture that is four feet tall for example, having a self supporting structure 8 with a diameter of about two feet at its widest portion, a suitable weighted cylindrical block 114 has a diameter of about six inches, a cylindrical side wall of about two and three-fourths inches and a weight of about twenty pounds.

The weighted cylindrical block 114 has a planar bottom wall 116 and a planar top wall 118. The planar bottom wall 116 of the weighted cylindrical block 114 is coplanar with the flat bottom wall 100 of the bottom circular aperture 98 of the self-positioning structure 8 when the weighted cylindrical block 114 is fully received in the weight receiving recess 102. At such time, the planar top wall 118 of the weighted cylindrical block 114 is in abutting relationship around its peripheral edge with the annular flange 106 of the weight receiving recess 102.

The screw receiving bores 112 open to countersunk recesses 113 extending inwardly of the bottom wall 100 of the cylindrical block 114. The heads 115 of the lag screws 110 seat in the countersunk recesses 113 when the cylindrical block is secured in the weight receiving recess 102.

An electrically powered blower 120 is mounted at the lower end of the cylindrical cavity 48 which extends through the elongated support section 12, having conductors connected between the switch 14 and the electric motor of the blower 120, to operate the blower 120 when switch 14 is in its contact closed position. The blower 120 is positioned to flow air upwardly through the cylindrical cavity 48 of the elongated support section 12 to cool the bulb 60 mounted at the upper end, and to draw cool ambient air through the ventilating apertures 26 around the annular recess 24 of the self-positioning structure 8 into the cavity 20 thereof which is in open communication with the cylindrical cavity 48 of the elongated support section 12 and with the blower 120.

The self-positioning structure 8 is integrally joined to the elongated support section 12, and the upwardly sloping wall 28, the annular recess 24, the lower peripheral wall 94 and the weight receiving recess 102 of the self-positioning structure 8 are all integrally joined as a continuous unit.

A reflector 124 in the form of a flexible flap 126 is provided for placing around a portion of the dome 62 to reflect light from the bulb 60 out through the remaining portion of dome 62.

The flexible flap reflector 124 comprises an inner composite layer 128 of flexible sheet material having an inwardly facing coating of stainless steel foil 130 with a backing of fiberglass cloth, and an outer layer 132 of flexible sheet material which is water proof, oil resistant and substantially non-flammable. The inner and outer layers are superimposed one over the other.

The lower edge 134 of the flexible flap reflector 124 has a length which is about half the length of the circumference around the enlarged annular section 42 of the elongated support section 12. It has a depending mid-portion 136 with pins 138 securing the lower edge 134 of the flexible flap reflector 124 to the enlarged annular section 42 thereby permanently securing the flap reflector 124 to the lamp fixture.

The upper edge 140 of the flexible flap reflector 124 is shorter than the lower edge 134, and is contoured into an arcuate configuration to fit around a portion of the spherical segment top wall 68 of the dome 62. By way of example, if the length of the lower edge 134 is twelve inches, the length of the shorter upper edge 140 may be about seven inches to fit a dome having a cylindrical side wall diameter of about six inches and a height of about eight inches. In such case, the side edges 142 and 144 of the flexible flap reflector 124 are about nine inches long.

The flexible flap reflector 124 is secured to the dome 62 when in use by four snaps. When not in use, it may be unsnapped, folded and rolled up for storage at the base of the dome where its lower edge 134 is secured to the enlarged annular section 42 of the elongated support section 12. Another snap holds the flexible flap reflector 124 in its folded up position until it is again desired to use the reflector by unfolding, unrolling and snapping in place on the wall of the dome.

A first securing snap 146 is located on the flexible flap reflector 124 in the corner bounded by the side edge 142 and lower edge 134, a second securing snap 148 in the corner bounded by the side edge 144 and lower edge 134, a third securing snap 150 in the corner bounded by the side edge 144 and upper edge 140, and a fourth securing snap 152 in the corner bounded by the side edge 142 and upper edge 140.

Cooperating snaps 154 and 156 are provided on the cylindrical wall of the enlarged annular section 42 to receive and releasably hold snaps 146 and 148 of the flexible flap reflector 124. Cooperating snaps 158 and 160 are provided on the spherical segment top wall 68 of the dome 62 to receive and releasably hold snaps 150 and 152 of the flexible flap reflector 124.

To fold the flexible flap reflector 124 when it is unsnapped from the cooperating snaps 154, 156, 158 and 160, the side edge 142 of the reflector 124 is folded over to about the longitudinal center line, the opposite side edge 144 is likewise folded over from its side to about the longitudinal center line, the folded flexible flap reflector is then rolled up from the upper edge downward, rolling it toward its inwardly facing side 162 having the coating of stainless steel foil. When fully rolled up to the lower edge 134, a snap 154 in about the middle of the outer layer 132 of the flexible flap reflector 124 comes into registration with cooperating snap 166 on the cylindrical wall of the enlarged annular section 42 positioned midway between cooperating snaps 154 and 156. The cooperating snap 166 receives and releasably holds snap 164 to thereby hold the flexible flap reflector 124 in its rolled up position for storage on the lamp fixture itself when not in use.

The inner composite layer 128 of the flexible flap reflector 124 includes a sheet of heavy weight, plain weave fiberglass cloth to which the coating of stainless steel foil 130 is laminated on one side by a special high temperature adhesive with heat, chemical and moisture resistance. The inner composite layer 128 has a temperature resistance up to plus 500 degrees Fahrenheit, is flame resistant, and has substantial tensile, tear and burst strength. A suitable sheet material for the inner composite layer 128 is available from Alpha Associates, Inc. of Woodbridge, N.J. identified as Alpha Maritex Style 2025/9480 ST-HT.

The outer layer 132 of the flexible flap reflector 124 overlaps the inner composite layer 128 on its side opposite the coating of stainless steel foil 130, and is affixed to the inner composite layer 128 by sewing around the outer edges, or by any conventional method. The outer layer 132 comprises a flexible sheet of fiberglass fabric impregnated with silicone rubber which is water and oil resistant, flame retardant, can be easily sewn, is lightweight, has substantial tensile, tear and burst strength and is useable throughout a temperature range from minus 67 degrees Fahrenheit up to plus 500 degrees Fahrenheit for 1,000 hours on a continuous basis with no change in its material characteristics, and up to plus 700 degrees Fahrenheit for 100 hours on an intermittent basis with minimum weight loss and 50% strength loss.

A suitable sheet material for the outer layer 132 is also available from Alpha Associates, Inc. of Woodbridge, N.J. identified as Alpha Maritex Style 3259-2-SS which meets U.S. Military Specification MIL-C-20079P and Military Specification MIL-1-24244.

In a modified form of the invention, the elongated support section 1200 terminates at its upper end in an upwardly projecting spherical ball member 168 which is received in the cavity 170 of a spherical segment 172 depending from the base 174 of the lamp assembly 400. The diameter of the ball member 168 corresponds to that of the spherical segment cavity 170. The cavity 170 receives the spherical ball member 168 far enough therein to include its diameter within the cavity 170 of the spherical segment 172, whose open circular wall 176 through which the ball member 168 extends has a diameter which is less than that of the ball member 168. The ball member 168 is thereby held within the spherical segment cavity 170. The portion of the ball member 168 within the cavity 170 has a sufficient dimension and configuration to provide a relatively tight fit whereby the lamp assembly 400 can be held at any position to which it may be moved by rotation of the spherical segment 172 on the spherical ball member 168, but whereby the lamp assembly 400 can in fact be moved to any desired position permitted by rotation of the spherical segment 172 on the spherical ball member 168 received within the spherical segment cavity 170.

I claim:

1. A self-positioning lamp fixture, comprising an elongated lamp support structure to be supported in a vertical position on a horizontal surface, said lamp support structure having self-positioning means to position said lamp support structure in said vertical position when placed on said horizontal surface and to return said lamp support structure to said vertical position when tipped away therefrom, said lamp support structure having an upper end and a lower end, a lamp assembly supported at said upper end of said lamp support structure, said self-positioning means being at said lower end of said lamp support structure, said self-positioning means including a bottom wall of said lamp support structure, said bottom wall having the peripheral configuration of a segment of a sphere with a relatively large circumference at an upper end region and terminating in a relatively small circumference at a lower end surrounding a flat portion which is in full facing relationship to said horizontal surface when said lamp support structure is placed thereon to stabilize said lamp support structure in said vertical position, said flat portion of said lower end being formed with a downwardly opening recess, a ballast removably positionable in said recess, releasable securing means to releasably secure said removable ballast means to said lamp support structure until removed therefrom, said lamp support structure being integrally formed of a continuously extending material into a single unit from said upper end to said lower end including said bottom wall.

2. A self-positioning lamp fixture as set forth in claim 1, wherein said ballast is a weighted block, and said recess is defined by an open circular wall.

3. A self-positioning lamp fixture as set forth in claim 2, wherein said recess comprises a cylindrical peripheral wall extending upwardly from said open circular wall, to surround said recess, said weighted block includes a cylindrical peripheral wall having a circumference corresponding to that of said cylindrical wall surrounding said recess for reception of said weighted block therein.

4. A self-positioning lamp fixture, comprising an elongated lamp support structure to be supported in a vertical position on a horizontal surface, said lamp support structure having self-positioning means to position said lamp support structure in said vertical position when placed on said horizontal surface and to return said lamp support structure to said vertical position when tipped away therefrom, said lamp support structure having an upper end and a lower end, a lamp assembly supported at said upper end of said lamp support structure, said self-positioning means being at said lower end of said lamp support structure, said self-positioning means including a bottom wall of said lamp support structure, said bottom wall having the peripheral configuration of a segment of a sphere with a relatively large circumference at an upper end region and terminating in a relatively small circumference at a lower end surrounding a flat portion which is in full facing relationship to said horizontal surface when said lamp support structure is placed thereon to stabilize said lamp support structure in its said vertical position, said lamp support structure being integrally formed of a continuously extending material into a single unit from its said upper end to its said lower end including said bottom wall having said peripheral configuration of a segment of a sphere, wherein said flat portion of said bottom wall is an open circular wall, a recess extending upwardly from said open circular wall to receive a weighted block, including said weighted block, and means to secure said weighted block in said recess above said flat portion of said bottom wall, wherein said recess comprises a cylindrical peripheral wall extending upwardly from said open circular wall, to surround said recess, said weighted block includes a cylindrical peripheral wall having a circumference corresponding to that of said cylindrical wall surrounding said recess for reception of said weighted block therein, wherein said cylindrical peripheral wall of said recess terminates at its inward end opposite said open circular wall in a laterally extending annular wall portion, at least one screw receiving recess in said annular wall portion opening to said recess, at least one screw receiving passageway through said weighted block in registration with said screw receiving recess when said weighted block is received in said recess, and at least one elongated screw member received through said screw receiving passageway of said block and into said screw receiving recess, said screw receiving recess, said screw receiving passageway and said elongated screw member comprising said means to secure said block in said recess.

5. A self-positioning lamp fixture, comprising an elongated lamp support structure to be supported in a vertical position on a horizontal surface, said lamp support structure having self-positioning means to position said lamp support structure in said vertical position when placed on said horizontal surface and to return said lamp support structure to said vertical position when tipped away therefrom, said lamp support structure having an upper end and a lower end, a lamp assembly supported at said upper end of said lamp support structure, said self-positioning means being at said lower end of said lamp support structure, said self-positioning means including a bottom wall of said lamp support structure, said bottom wall having the peripheral configuration of a segment of a sphere with a relatively large circumference at its upper end region and terminating in a relatively small circumference at its lower end surrounding a flat portion which is in full facing relationship to said horizontal surface when said lamp support structure is placed thereon to stabilize said lamp support structure in its said vertical position, said lamp support structure being integrally formed of a continuously extending material into a single unit from said upper end to said lower end including said bottom wall having said peripheral configuration of a segment of a sphere, wherein said flat portion of said bottom wall is an open circular wall, a recess extending upwardly from said open circular wall to receive a weighted block, including said weighted block, and means to secure said weighted block in said recess above said flat portion of said bottom wall, wherein said recess comprises a cylindrical peripheral wall extending upwardly from said open circular wall, to surround said recess, said weighted block includes a cylindrical peripheral wall having a circumference corresponding to that of said cylindrical wall surrounding said recess for reception of said weighted block therein, wherein said cylindrical peripheral wall of said recess terminates at an inward end opposite said open circular wall in a laterally extending annular wall portion, a plurality of screw receiving recesses in said annular wall portion opening to said recess, a corresponding plurality of screw receiving passageways through said weighted block in registration with respective ones of said screw receiving recesses when said weighted block is received in said recess, and a corresponding plurality of elongated screw members received through respective ones of said screw receiving passageways of said block and into respective ones of said screw receiving recesses, said screw receiving recesses, said screw receiving passageways, and said elongated screw members comprising said means to secure said block in said recess.

6. A self-positioning lamp fixture comprising an elongated lamp support structure to be supported in a vertical position on a horizontal surface, said lamp support structure having self-positioning means to position said lamp support structure in said vertical position when placed on said horizontal surface and to return said lamp support structure to said vertical position when tipped away therefrom, said lamp support structure having an upper end and a lower end, a lamp assembly supported at said upper end of said lamp support structure, said self-positioning means being at said lower end of said lamp support structure, said self-positioning means including a bottom wall of said lamp support structure, said bottom wall having the peripheral configuration of a segment of a sphere with a relatively large circumference at its upper end region and terminating in a relatively small circumference at its lower end surrounding a flat portion which is in full facing relationship to said horizontal surface when said lamp support structure is placed thereon to stabilize said lamp support structure in its said vertical position, said lamp support structure being integrally formed of a continuously extending material into a single unit from said upper end to said lower end including said bottom wall said flat portion of said bottom wall being an open circular wall, a cylindrical wall extending upwardly from said recess for defining an upwardly extending recess a weighted block received in said recess, means for securing said weighted block in said recess above said flat portion of said bottom wall, said weighted block including a cylindrical peripheral wall having a circumference corresponding to that of said cylindrical wall surrounding said recess, said cylindrical peripheral wall of said recess terminating at an inward end opposite said open circular wall in a laterally extending annular wall portion, said securing means including a plurality of screw receiving recesses in said annular wall portion opening to said recess, a corresponding plurality of screw receiving passageways through said weighted block in registration with respective ones of said screw receiving recesses when said weighted block is received in said recess, a corresponding plurality of elongated screw members received through respective ones of said screw receiving passageways of said block and into respective ones of said screw receiving recesses, said lamp support structure including a lamp support structure cavity extending from said upper end to said lower end, said laterally extending annular wall portion of said recess including an annular flange surrounding an aperture opening to said lamp support structure cavity from said recess, said weighted block having said cylindrical peripheral wall and an upper end wall and a lower end wall, said upper end wall of said weighted block being in abutting contact against said annular flange around a peripheral edge thereof when said weighted block is received in said recess, said lower end wall of said weighted block being in coplanar relationship with said open circular wall which comprises said flat portion of said bottom wall of said lamp support structure when said weighted block is received and secured in said recess.

7. A self-positioning lamp fixture, comprising an elongated lamp support structure to be supported in a vertical position on a horizontal surface, said lamp support structure having self-positioning means to position said lamp support structure in said vertical position when placed on said horizontal surface and to return said lamp support structure to said vertical position when tipped away therefrom, said lamp support structure having an upper end and a lower end, a lamp assembly supported at said upper end of said lamp support structure, said self-positioning means being at said lower end of said lamp support structure, said self-positioning means including a bottom wall of said lamp support structure, said bottom wall having the peripheral configuration of a segment of a sphere with a relatively large circumference at an upper end region and terminating in a relatively small circumference at a lower end surround a flat portion which is in full facing relationship to said horizontal surface when said lamp support structure is placed thereon to stabilize said lamp support structure in said vertical position, said lamp support structure being integrally formed of a continuously extending material into a single unit from its said upper end to its said lower end including said bottom wall having said peripheral configuration of a segment of a sphere, said elongated lamp support structure including an elongated neck portion having a cylindrical side wall of relatively small diameter extending from an upper neck end to a lower neck end, a downwardly sloping annular wall portion having progressively larger diameter as in a downward direction, said downwardly sloping annular wall portion being integrally joined around its upper portion to said elongated neck portion at said lower neck end, said downwardly sloping annular wall portion being integrally joined around its lower portion to an upper annular edge of an annular cord receiving recess, said annular cord receiving recess having a lower annular edge, said relatively large circumference upper end region of said bottom wall having said peripheral configuration of a segment of a sphere being integrally joined to said lower annular edge of said cord receiving recess, a cord receiving aperture opening to said cord receiving recess, an electrical cord having electrical conductors for connection to said lamp assembly extending through said cord receiving aperture to said lamp assembly at one end, an opposite end of said cord having an electrical plug, the portion of said electrical cord outwardly of said cord receiving aperture being receivable in said annular cord receiving recess for storage when not in use, and a switch connected to said conductors in said cord between said end connected at said lamp assembly and said end having said electrical plug.

8. A self-positioning lamp fixture as set forth in claim 7, wherein said lamp support structure includes a lamp support structure cavity extending from its said upper end to its said lower end, a plurality of ventilating apertures spaced apart around said annular cord receiving recess opening to said lamp support structure cavity from the ambient air to flow cooling air into said lamp support structure cavity up to its upper end and to said lamp assembly supported at said upper end, an electrically powered blower mounted in said lamp support structure cavity to flow cooling air from said ventilating apertures upwardly through said elongated neck portion to said lamp assembly.

9. A self-positioning lamp fixture as set forth in claim 8, wherein said upper end of said lamp support structure includes a laterally extending upper end wall and and an upper end wall aperture opening to said lamp support structure cavity, said lamp assembly including an electrical socket positioned and supported centrally of said upper end wall aperture, an electrical bulb in said electrical socket, a light transmitting dome supported on said upper end wall to cover said socket and bulb, a dome ventilation aperture in said dome, and an air passageway extending from said lamp support structure cavity, then passed said electrical socket and said electrical bulb into said dome and outwardly through said dome ventilation aperture.

10. A self-positioning lamp fixture as set forth in claim 9, including a dome ventilation cap seated in said dome ventilation aperture, said dome ventilation cap comprising a cover member having a cross-sectional dimension greater than that of said dome ventilation aperture, support means to support said cover member at a spaced apart position above said dome ventilation aperture located to overlay said dome ventilation aperture, and an air passageway between said dome ventilation aperture and said cover member to flow air from the interior of said dome through the dome ventilation aperture and out to the surrounding environment.

11. A self-positioning lamp fixture as set forth in claim 10, wherein said support means to support said cover member at said spaced apart position above said dome ventilation aperture comprises a plurality of leg members extending downwardly from said cover member positioned to engage the peripheral edge of said dome surrounding said dome ventilation aperture, each of said leg members having an outwardly facing surface, first rib means projecting outwardly from said outwardly facing surface of each of said leg members positioned thereon for initial contact with said peripheral edge of said dome surrounding said dome ventilation aperture when said ventilation cap is positioned on said dome, said leg members being sufficiently flexible to flex allowing said first rib means to pass said peripheral edge, and second rib means projecting outwardly from said outwardly facing surface of each of said leg members spaced apart from said first rib means in the direction toward said cover member and positioned on each of said leg members for contact with said peripheral edge of said dome surrounding said dome ventilation aperture after said first rib means have passed said peripheral edge and said leg members have snapped back to their original position.

12. A self-positioning lamp fixture as set forth in claim 9, including an electrical socket support member at said laterally extending upper end wall of said lamp support structure to support said electrical socket centrally of said upper end wall aperture, said electrical socket support member having a plurality of air flow apertures to enable flow of cooling air from said lamp support structure cavity through said air flow apertures, then passed said electrical socket and said electrical bulb into said dome and outwardly through said dome ventilation aperture.

13. A self-positioning lamp fixture as set forth in claim 12, wherein said electrical socket support member comprises a screen having a peripheral edge secured to said laterally extending upper end wall around said upper end wall aperture, said screen extending across said upper end wall aperture, a centrally located aperture in said screen to receive said electrical socket therein, and securing means to secure said electrical socket to said screen.

14. A self-positioning lamp fixture as set forth in claim 9, including a flexible sheet reflector having an inwardly facing reflective surface, said flexible sheet reflector being foldable into a folded up position when not in use and unfoldable into an unfolded position when ready for use, reflector support means to support said flexible sheet reflector when unfolded in position with its said reflective surface facing toward a said electrical bulb in said electrical socket to reflect light therefrom.

15. A self-positioning lamp fixture as set forth in claim 14, wherein said flexible sheet reflector has a lower reflector edge, an upper reflector edge, a first reflector side edge and an opposite second reflector side edge, said reflector support means comprising a first snap member in the corner of said reflector bounded by said lower reflector edge and said first reflector side edge, a second snap member in the corner of said reflector bounded by said lower reflector edge and said second reflector side edge, a third snap member in the corner of said reflector bounded by said upper reflector edge and said second reflector side edge, a fourth snap member in the corner of said reflector bounded by said upper reflector edge and said first reflector side edge, a first cooperating snap member positioned on said cylindrical side wall of said neck portion of said lamp support structure adjacent its said upper end to receive and releasably hold said first snap member, a second cooperating snap member positioned on said cylindrical side wall of said neck portion of said lamp support structure adjacent its said upper end to receive and releasably hold said second snap member, a third cooperating snap member positioned on said dome to receive and releasably hold said third snap member, and a fourth cooperating snap member positioned on said dome to receive and releasably hold said fourth snap member.

16. A self-positioning lamp fixture as set forth in claim 15, including permanent fastening means to permanently fasten said flexible sheet reflector to said lamp fixture at a location thereon to enable folding said flexible sheet reflector into its said folded up position and unfolding said flexible sheet reflector into its unfolded position with its said reflective surface facing toward a said electrical bulb in said electrical socket to reflect light therefrom.

17. A self-positioning lamp fixture as set forth in claim 16, wherein said permanent fastening means includes at least one pin through a portion of said lower reflector edge of said flexible sheet reflector and into said cylindrical side wall of said neck portion of said lamp support structure adjacent its said upper end to permanently hold said flexible sheet reflector thereto.

18. A self-positioning lamp fixture as set forth in claim 15, including storage fastening means to releasably hold said flexible sheet reflector in its said folded up position until it is desired to release said storage fastening means to unfold said flexible sheet reflector for use.

19. A self-positioning lamp fixture as set forth in claim 18, wherein said storage fastening means includes a storage snap fastener positioned in the mid-region of said flexible sheet reflector having an interconnecting snap element facing outwardly from the outwardly facing surface of said flexible sheet reflector opposite from its said reflective surface, said storage snap fastener being positioned on said outwardly facing surface at a location which comes into facing relationship with said cylindrical side wall of said neck portion of said lamp support structure adjacent said upper end when said flexible sheet reflector is folded into said folded up position for storage until said flexible sheet reflector is to be re-used, and a cooperating storage snap fastener having a cooperative inter-connecting snap element to receive and releasably hold said inter-connecting snap element of said first mentioned storage snap fastener, said cooperating storage snap fastener being located on said cylindrical side wall of said neck portion of said lamp support structure adjacent said upper end at said point at which said first mentioned snap fastener comes into facing relationship therewith.

20. A self-positioning lamp fixture as set forth in claim 14, wherein said flexible sheet reflector includes an inner flexible sheet comprising a first sheet of stainless steel foil which comprises said inwardly facing reflective surface, said first sheet of stainless steel foil being adhesively laminated to a second sheet, said second sheet comprising a sheet of heavy weight, plain weave, fiberglass cloth.

21. A self-positioning lamp fixture as set forth in claim 20, wherein said flexible sheet reflector includes an outer flexible sheet backing said inner flexible sheet adjacent its said second sheet, said outer flexible sheet comprises a flexible sheet of fiberglass impregnated with silicone rubber which is water and oil resistant and flame retardant.

22. A self-positioning lamp fixture as set forth in claim 21, wherein said inner flexible sheet comprises a flexible sheet product identified as Alpha Maritex Style 2025/9480 ST-HT available from Alpha Associates, Inc. of Woodbridge, N.J. said outer flexible sheet comprises a flexible sheet product identified as Alpha Maritex Style 3259-2-SS also available from said Alpha Associates, Inc. of Woodbridge, N.J.

23. A self-positioning lamp fixture as set forth in claim 7, including an electrical outlet positioned on said lamp support structure and connected to said conductors in said electrical cord.

24. A self-positioning lamp fixture as set forth in claim 23, wherein said electrical outlet and said switch are located on said downwardly sloping annular wall portion having said progressively larger diameter in a downward direction.

25. A self-positioning lamp fixture as set forth in claim 1, including universal swivel means at said upper end of said lamp support structure, said lamp assembly being supported on said universal swivel means for pivoting thereof in any pivotable direction.

26. A self-positioning lamp fixture as set forth in claim 25, wherein said universal swivel means comprises a socket member having a cavity therein with an interior cavity wall having the peripheral configuration of a segment of a sphere having an equatorial circumference of a pre-determined dimension and a circular open wall entrance to said cavity having a circumference smaller than said equatorial circumference of said cavity, and an insert member received in said cavity, said insert member having an outer peripheral wall having the peripheral configuration of a segment of a sphere corresponding in dimension to that of said interior cavity wall for a relatively tight fit to frictionally hold said socket member relative to said insert member at whatever position to which said socket member is pivoted while permitting pivotal movement of said socket member on said insert member, said insert member having an equatorial circumference corresponding in dimension to said pre-determined dimension of said equatorial circumference of said cavity of said socket member, said equatorial circumference of said insert member being received within said cavity of said socket member whereby said insert member cannot be withdrawn from said cavity through said circular open wall entrance having said smaller circumference.

27. A self-positioning lamp fixture comprising an elongated lamp support structure to be supported in vertical position on a horizontal surface, said elongated lamp support structure having a bottom portion with downwardly and inwardly rounded side walls and an elongated upper portion extending upwardly from said bottom portion, a bulb-receiving lamp socket assembly mounted on an upper end of said elongated upper portion, means for electrically connecting said socket assembly to a power source, said bottom portion being formed with a downwardly opening recess in an underside thereof, a ballast releasably secured in said recess without any portion thereof extending substantially out of said recess for counterweighing the weight of the upper portion and the socket assembly mounted thereon in order to effect self-positioning of the elongated lamp support structure in a vertical position when placed on said horizontal surface and to return the elongated lamp support structure to said vertical position when tipped away therefrom.

28. A self-positioning lamp fixture as set forth in claim 27 in which said ballast has a flat bottom end disposed in substantially co-planar relation with a bottom end of said recess for stabilizing upright positioning of said support structure.

29. A self-positioning lamp fixture as set forth in claim 27 in which said upper portion is smaller in diameter than said bottom portion for reducing the weight thereof and facilitating self-positioning of said support structure.

30. A self-positioning lamp fixture as set forth in claim 27 in which said recess is cylindrical in configuration and said ballast is cylindrically shaped.

31. A self-positioning lamp fixture comprising an elongated lamp support structure to be supported in vertical position on a horizontal surface, said elongated lamp support structure having a bottom portion in the form of a segment of a sphere and an elongated upper portion of smaller diameter than said bottom portion, a bulb-receiving lamp socket assembly mounted on the upper end of said elongated upper portion, means for electrically connecting said socket assembly to a power source, said lower portion including a ballast for counterbalancing the weight of the upper portion and the socket assembly mounted thereon in order to effect self-positioning of the elongated structure in a vertical position when placed on said horizontal surface and to return the elongated structure to said vertical position when tipped away therefrom, and said lamp support structure including said upper and lower portions being integrally formed a single unit.

32. A self-positioning lamp fixture as set forth in claim 31 in which said electrical connecting means includes an electric cord coupled to said socket assembly and extending downwardly through said elongated upper portion and out said lamp support structure through an aperture in said bottom portion, and said bottom portion being formed with an outwardly opening recess about its perimeter within which said cord may be wound for storage.

33. A self-positioning lamp fixture as set forth in claim 31 including an electrically powered blower mounted within said support structure for creating an airflow upwardly through said elongated upper portion to said lamp socket assembly and a bulb received therein.

34. A self-positioning lamp fixture as set forth in claim 33 including a light transmitting dome supported on the upper end of the elongated upper portion of said support structure for covering said lamp socket assembly and a bulb received therein, said dome defining a ventilation aperture for permitting a flow of ventilating air upwardly through said support structure, passed said socket assembly and bulb received therein, and out said ventilation aperture.

35. A self-positioning lamp fixture as set forth in claim 34 including a dome ventilation cap mounted in said dome ventilation aperture, said dome ventilation cap comprising a cover member larger in size than said dome ventilation aperture, means supporting said cover member spaced apart in relation to said dome ventilating aperture for defining an air passage way between said dome ventilation aperture and said cover member.

36. A self-positioning lamp fixture as set forth in claim 35 including means for supporting said socket assembly in the upper end of said upper elongated portion and for defining a plurality of air flow apertures for enabling the flow of ventilating air through said lamp support structure, said socket assembly air flow apertures, and said dome ventilation aperture.

37. A self-positioning lamp fixture as set forth in claim 31 including a flexible reflector having a reflective surface that is positionable in partially surrounding relation to said socket assembly for directing light emitted from a bulb therein, said flexible sheet reflector being foldable into a folded stored condition when not in use.

38. A self-positioning lamp fixture as set forth in claim 31 including universal swivel means in the upper end of said lamp support structure for supporting said lamp socket assembly for selected movement in any pivotable direction.

39. A self-positioning lamp fixture as set forth in claim 38 wherein said universal swivel means comprises a socket member having a cavity in the form of a segment of a sphere, an insert number upon which the socket assembly is mounted, and said insert member being received in said cavity for relative pivotal positioning.

40. A self-positioning lamp fixture as set forth in claim 31 in which said upper portion is smaller in diameter than said bottom portion for reducing the weight thereof and facilitating self-positioning of said support structure.

41. A self-positioning lamp fixture as set forth in claim 32 in which said upper portion is smaller in diameter than said bottom portion for reducing the weight thereof and facilitating self-positioning of said support structure.

42. A self-positioning lamp fixture comprising an elongated lamp support structure to be supported in vertical position on a horizontal surface, said elongated lamp support structure having a bottom portion in the form of a segment of a sphere and an elongated upper portion, a bulb-receiving lamp socket assembly mounted on the upper end of said elongated upper portion, means for electrically connecting said socket assembly to a power source, said lower portion including a ballast for counterweighing the weight of the upper portion and the socket assembly mounted thereon in order to effect self-positioning of the elongated structure in a vertical position when placed on said horizontal surface and to return it to said vertical position when tipped away therefrom, and universal swivel means at said upper end of said lamp support structure for supporting said lamp socket assembly for selected movement in any pivotable direction.

43. A self-positioning lamp fixture as set forth in claim 42 wherein said universal swivel means comprises a socket member having a cavity in the form of a segment of a sphere, an insert number upon which said socket assembly is mounted, and said insert member being received in said cavity for relative pivotal positioning.

* * * * *